US011770646B2

(12) United States Patent
Tang

(10) Patent No.: US 11,770,646 B2
(45) Date of Patent: Sep. 26, 2023

(54) MICROPHONE BOOM ROTATION MECHANISM FOR HEADSETS

(71) Applicant: Plantronics, Inc., Santa Cruz, CA (US)

(72) Inventor: Wen Tang, SuZhou (CN)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 17/705,113

(22) Filed: Mar. 25, 2022

(65) Prior Publication Data

US 2022/0312094 A1 Sep. 29, 2022

(30) Foreign Application Priority Data

Mar. 29, 2021 (CN) ..... 202110333347.8

(51) Int. Cl.
*H04R 1/10* (2006.01)
*H04R 1/08* (2006.01)

(52) U.S. Cl.
CPC ..... *H04R 1/08* (2013.01); *H04R 1/105* (2013.01); *H04R 1/1008* (2013.01); *H04R 1/1091* (2013.01); *H04R 2201/107* (2013.01)

(58) Field of Classification Search
CPC . H04R 1/00; H04R 1/02; H04R 1/028; H04R 1/04; H04R 1/08; H04R 1/083; H04R 1/10; H04R 1/1008; H04R 1/1041; H04R 1/105; H04R 1/1058; H04R 1/1066; H04R 1/1075; H04R 1/1091
See application file for complete search history.

(56) References Cited

U.S. PATENT DOCUMENTS 4,634,816 A * 1/1987 O'Malley ..... H04M 1/05 381/384
2001/0017925 A1* 8/2001 Ceravolo ..... H04R 5/0335 381/370
2001/0036291 A1* 11/2001 Pallai ..... H04R 1/342 381/370
2011/0019859 A1 1/2011 Van Der Beek et al.
2017/0041695 A1* 2/2017 Hernandez Vazquez ..... H04R 1/105

FOREIGN PATENT DOCUMENTS

CN 207166708 U 3/2018
EP 1478207 A2 11/2004

OTHER PUBLICATIONS

CN 2017166708U, English Translation, Rong-Cheng Sun, Dated: Mar. 30, 2018.*

* cited by examiner

*Primary Examiner* — Thang V Tran
(74) *Attorney, Agent, or Firm* — Quarles & Brady LLP

(57) ABSTRACT

A communication headset includes an earcup, a headband, and a microphone boom assembly. The microphone boom assembly includes a microphone boom, a gear assembly disposed on the earcup and supporting the microphone. The gear assembly enables a rotation of the microphone boom.

18 Claims, 8 Drawing Sheets

MICROPHONE BOOM ROTATION MECHANISM FOR HEADSETS

CROSS REFERENCE TO RELATED APPLICATIONS

This application claims priority under 35 U.S.C. § 119(a) to Chinese Patent Application No. 202110333347.8 filed on Mar. 29, 2021. Chinese Patent Application No. 202110333347.8 is incorporated herein by reference in its entirety.

BACKGROUND

Communication headsets may be equipped with one or more microphones. The one or more microphones may be disposed on a microphone boom of the headset. Adjustability of the microphone boom may be desirable, for example, to accommodate the anatomy of different headset users and/or preferences of the different headset users.

SUMMARY

In general, in one aspect, one or more embodiments relate to a communication headset comprising an earcup; a headband; and a microphone boom assembly comprising: a microphone boom; a gear assembly disposed on the earcup and supporting the microphone, wherein the gear assembly enables a rotation of the microphone boom.

In general, in one aspect, one or more embodiments relate to a gear assembly for rotation of a microphone boom of a communication headset, the gear assembly comprising: a first spur gear engaging with a gear associated with the microphone boom, wherein the rotation of the microphone boom causes rotation of the first spur gear; and a gear assembly base rotatably supporting the microphone boom, and rotatably supporting the first spur gear.

In general, in one aspect, one or more embodiments relate to a method for controlling rotation of a microphone boom of a communication headset, the method comprising: receiving a microphone boom adjustment input; driven by the adjustment input, rotating the microphone boom; generating, by a gear assembly of the communication headset, a torque countering the rotation of the microphone boom.

Other aspects of the disclosure will be apparent from the following description and the appended claims.

DETAILED DESCRIPTION

Figure 1:
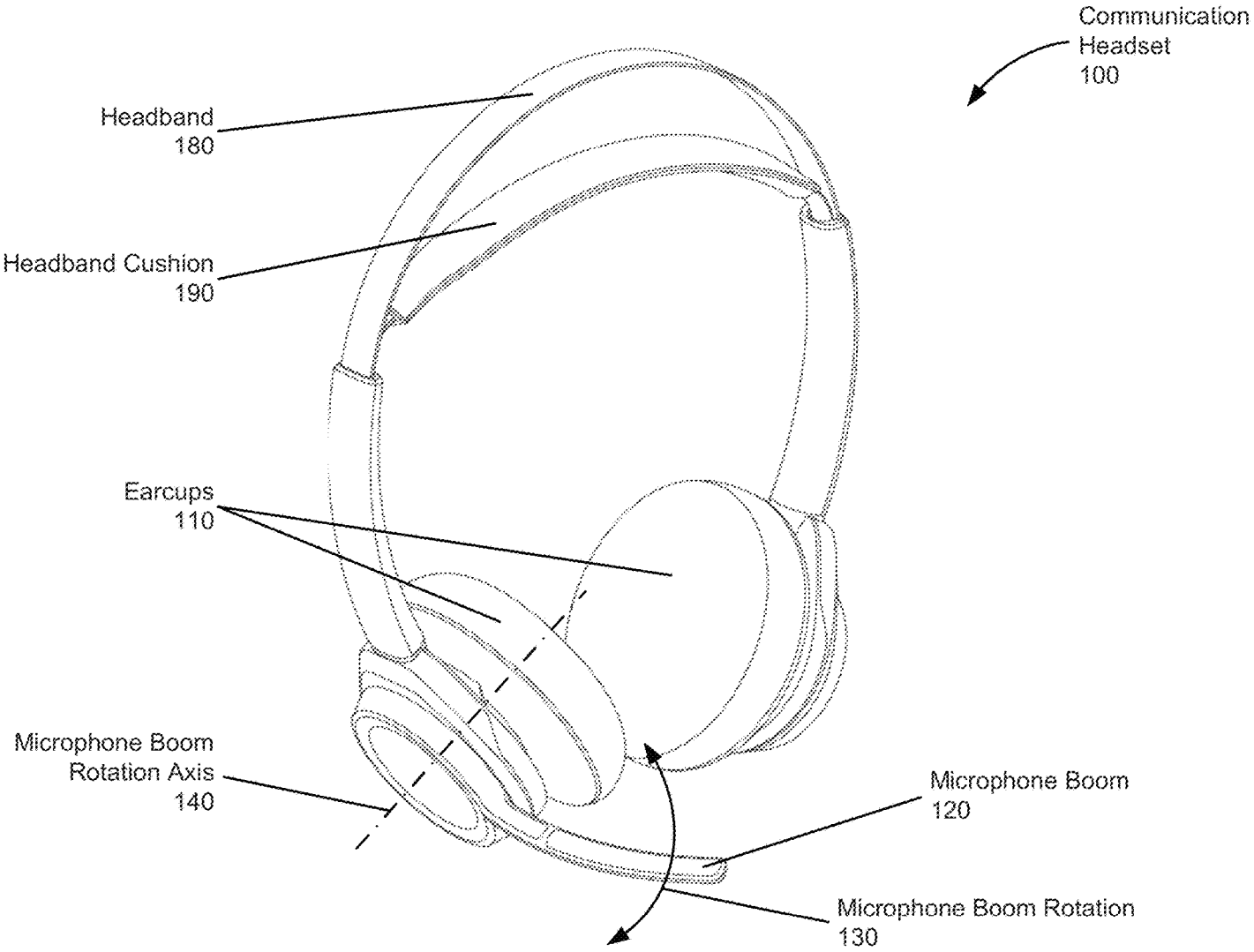
FIG. 1 shows a communication headset in accordance with one or more embodiments of the disclosure.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Further, although the description includes a discussion of various embodiments of the invention, the various disclosed embodiments may be combined in virtually any manner. All combinations are contemplated herein.

Communication headsets may be equipped with one or more microphones. The one or more microphones may be disposed on a microphone boom of the headset. Adjustability of the microphone boom may be desirable, for example, to accommodate the anatomy of different headset users and/or preferences of the different headset users, as well as the particular use (e.g., whether only listening to audio or also transmitting audio). The adjustability may be provided by one or more joints of the microphone boom. To ensure that, once adjusted by the user, the microphone boom remains in the desired position and/or orientation, a certain level of a friction force and/or torque in the one or more joints is desirable. If the friction and/or force is too low, slippage in the one or more joints may exist, causing the microphone boom to no longer remain at the desired position. If the friction and/or force is too high, it may be challenging for the user to adjust the position and/or orientation of the microphone boom as desired.

Turning to FIG. 1, a communication headset (100), in accordance with one or more embodiments of the disclosure, is shown. The communication headset (100) may be worn by a user (not shown). Applications of the communication headset include, but are not limited to, office environments, call centers, etc. The communication headset (100) may include one or two earcups (110), a microphone boom (120), a headband (180), a headband cushion (190). Each of these components is subsequently described.

The earcups (110) may be configured to be placed on or over the user's ears when the user wears the communication headset (100). The earcups (110) may be made from any material, e.g., a plastic or composite material. Each of the earcups (110) may include one or more speakers to transmit an audio signal to the user. To increase the wearing comfort, and or ambient noise suppression, the earcups (110) may be equipped with a cushioning. The communication headset (100) may include one or two earcups (110). In one or more embodiments, an earcup (110) provides an interface to a microphone boom (120), as described below.

The earcups (110) may be held in position on the user's head by the headband (180). The headband may be worn over the user's head to hold the headset in place. The headband may have spring-like characteristics and may be adjustable. A headband cushion (190) may be provided to increase the wearing comfort.

In one or more embodiments, the communication headset includes a microphone boom (120). The microphone boom (120) may be equipped with one or more microphones to support two-way communication, using the communication headset (100). The microphone boom (120) may be adjustable in one or more degrees of freedom to position/orient the microphone boom (120) relative to the user's mouth as desired by the user and/or to improve the speech signal picked up by the microphone(s). In one or more embodiments, the communication headset (100) provides a microphone boom rotation (130). The microphone boom rotation (130) may be provided by a microphone boom rotation mechanism that is disposed on or integrated in one of the earcups (110), as discussed in detail below. The microphone boom rotation mechanism may prevent microphone boom rotation (130), unless the user applies a force/torque to the microphone boom (120), e.g., to change the position/orientation of the microphone boom (120).

The microphone boom rotation (130) is about a boom rotation axis (140). The microphone boom rotation axis (140) may be located and oriented as shown in FIG. 1. The boom rotation axis may be approximately perpendicular to the plane of the outer surface of the earcup (e.g., perpendicular to the user's head when worn). Further, the boom rotation axis may be approximately perpendicular to the longitudinal axis of the boom, whereby the longitudinal axis is along the length of the boom. By way of an example, the boom rotation axis is defined such that the longitudinal axis of the boom may rotate from being parallel with the headband to being perpendicular with the headband. The boom rotation axis may traverse the earcup (110) in a central region of the earcup (110). Additional details are discussed in reference to FIGS. 2, 3, 4A, 4B, 5A, and 5B.

While FIG. 1 shows a configuration of components, other configurations may be used without departing from the scope of the invention. For example, the communication headset (100) may have one or two earcups, may or may not include a headband cushion, may be wired or wireless, may include additional degrees of freedom in the microphone boom (120), etc. By way of another example, the communication headset (100) may have a headband that extends in a different direction (e.g., around the back of the user's head) that is omitted.

Figure 2:
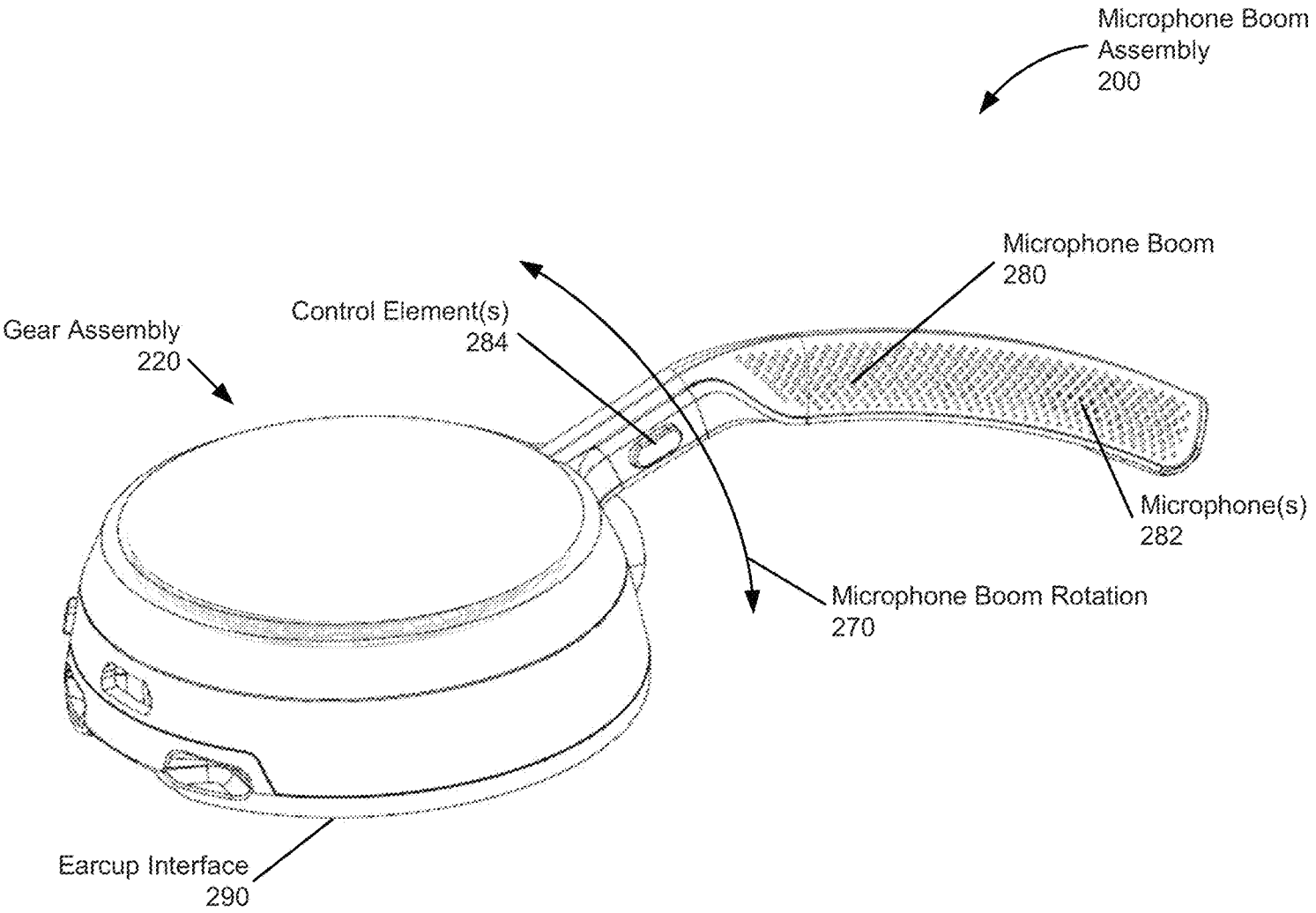
FIG. 2 shows a microphone boom assembly in accordance with one or more embodiments of the disclosure.

Turning to FIG. 2, a microphone boom assembly (200), in accordance with one or more embodiments of the disclosure, is shown. The microphone boom assembly (200) includes a gear assembly (220) and a microphone boom (280).

In one or more embodiments, the gear assembly (220) enables the microphone boom rotation (270) of the microphone boom (280). The gear assembly is disposed on an earcup (e.g., as shown in FIG. 1) at the earcup interface (290). The gear assembly (220) may be a separate element disposed on the earcup, e.g., attached by screws, clips, glue, etc. Alternatively, the gear assembly (220) may be a component of the earcup, such that the earcup houses the components of the gear assembly (220). A detailed description of the gear assembly (220) is provided below.

In one or more embodiments, the microphone boom (280) includes one or more microphones (282). The microphone boom (280) may further include one or more control elements (284). The control element(s) (284) may include buttons for muting the microphone(s), controlling a microphone gain, etc. The microphone boom (280) may be rigid or flexible. The microphone boom (280) may be made of any material, e.g., plastic or composite materials.

Figure 3:
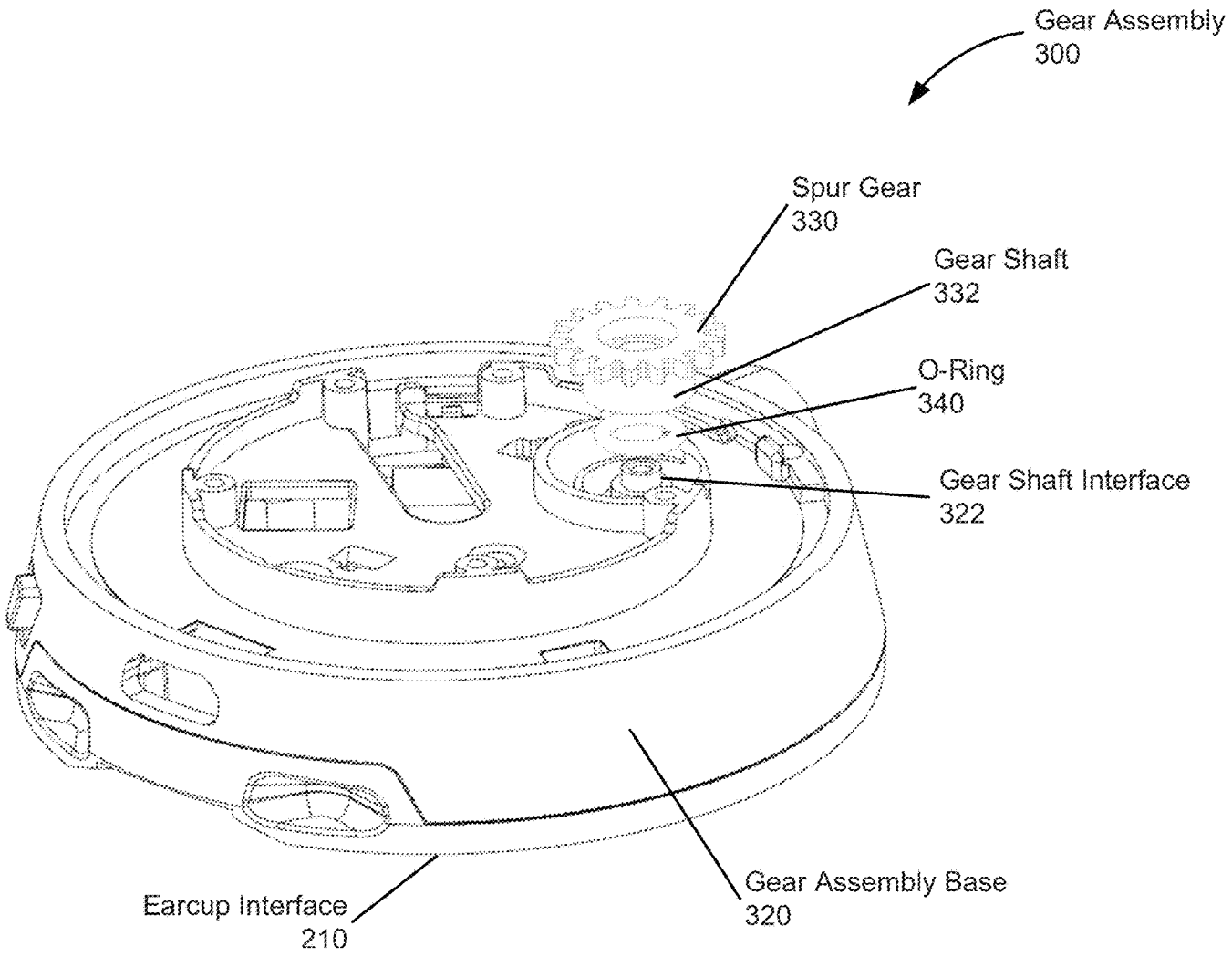
FIG. 3 shows a gear assembly in accordance with one or more embodiments of the disclosure.

Turning to FIG. 3, a gear assembly (300), in accordance with one or more embodiments of the disclosure, is shown. The gear assembly (300) includes a gear assembly base (320), a spur gear (330), and an O-ring (340). Other elements, not shown in FIG. 3, may be part of the gear assembly (300). These other elements are described, for example, in reference to FIGS. 4A, 4B, 5A, and 5B.

The gear assembly base (320) may be disposed on an earcup at the earcup interface (210). The gear assembly base (320) may be a part of the earcup, or the gear assembly may be a component separate from the earcup, disposed on the earcup. The gear assembly base (320) may be made of any material, for example a plastic or composite material. In one or more embodiments, the gear assembly base (320) accommodates other components of the gear assembly (300), enabling a rotation of the microphone boom, as previously described. The gear assembly (300) may generate a defined level of friction, such that a headset user may adjust the microphone boom in an effortless manner. The level of friction, in one or more embodiments, is sufficient to keep the microphone boom stationary unless the user applies a sufficient force/torque to cause a readjustment. Sufficient, as used herein, refers to an amount of force/torque that is greater than an amount of force caused by general movement of the user that is not directly applied by the user to the boom (e.g., greater than force caused by a user walking, jumping, or running while wearing the headset).

In one or more embodiments, the gear assembly base (320) accommodates the spur gear (330) as shown in FIG. 3. The spur gear (330) may be equipped with a gear shaft (332). The gear shaft (332) may be received by a gear shaft interface (322) of the gear assembly base (320) to enable rotation of the spur gear (330). The combination of the gear shaft (332) and the gear shaft interface (322) may include a pin of the spur gear (330) inserted into a hole of the gear assembly base (320), or any other configuration of elements suitable for supporting a spur gear. The spur gear (330) may be made from any material, such as a plastic material (e.g., nylon or acetal) or metal.

In one or more embodiments a defined amount of friction exists between the spur gear (330) and the gear assembly base (320). The friction results in a torque, when the spur gear is driven by movement of the microphone boom (described below in reference to FIGS. 4A and 4B). In one embodiment, an O-ring (340) is placed between the spur gear (330) and the gear assembly base (320) as shown in FIG. 3. As the spur gear (330) rotates, friction between the O-ring and the surfaces of the gear assembly base (320) and the spur gear (330) may produce a torque countering the rotation. The amount of friction and the resulting amount of torque may depend on various factors, including the material of the O-ring (340), the material of the spur gear (330) and/or the gear assembly base (320), the surface texture of the spur gear and/or the gear assembly base, the size of the O-ring, the pressure applied to the O-ring, etc. In one embodiment, the O-ring is a rubber O-ring. In one embodiment, the O-ring is a silicone O-ring. In one embodiment, a washer is used instead of an O-ring. In one embodiment, the friction may be a result of surface contact between the spur gear and the gear assembly base, without an O-ring or washer.

Figure 4A:
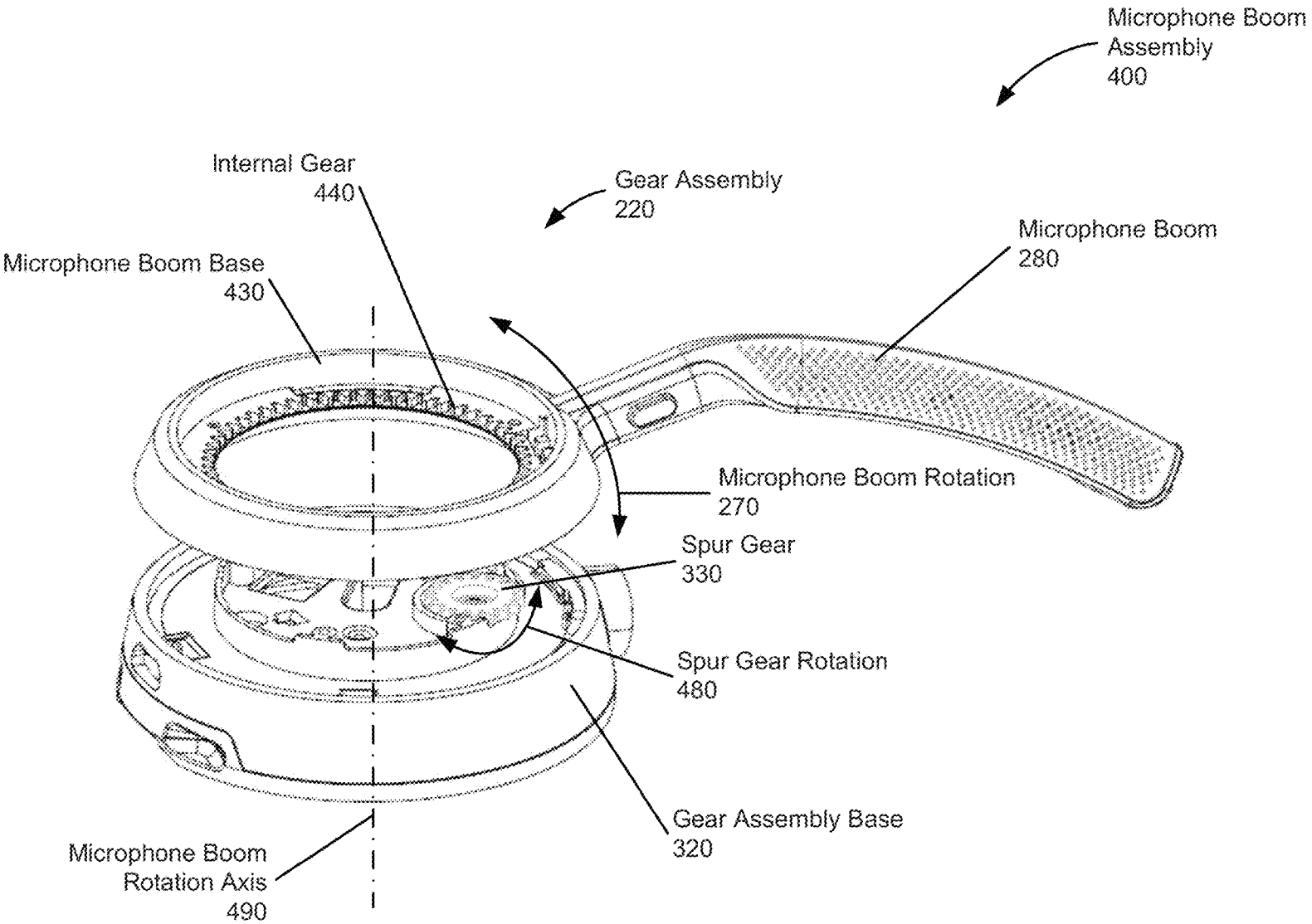
FIGS. 4A and 4B show microphone boom assemblies in accordance with one or more embodiments of the disclosure.
Figure 4B:
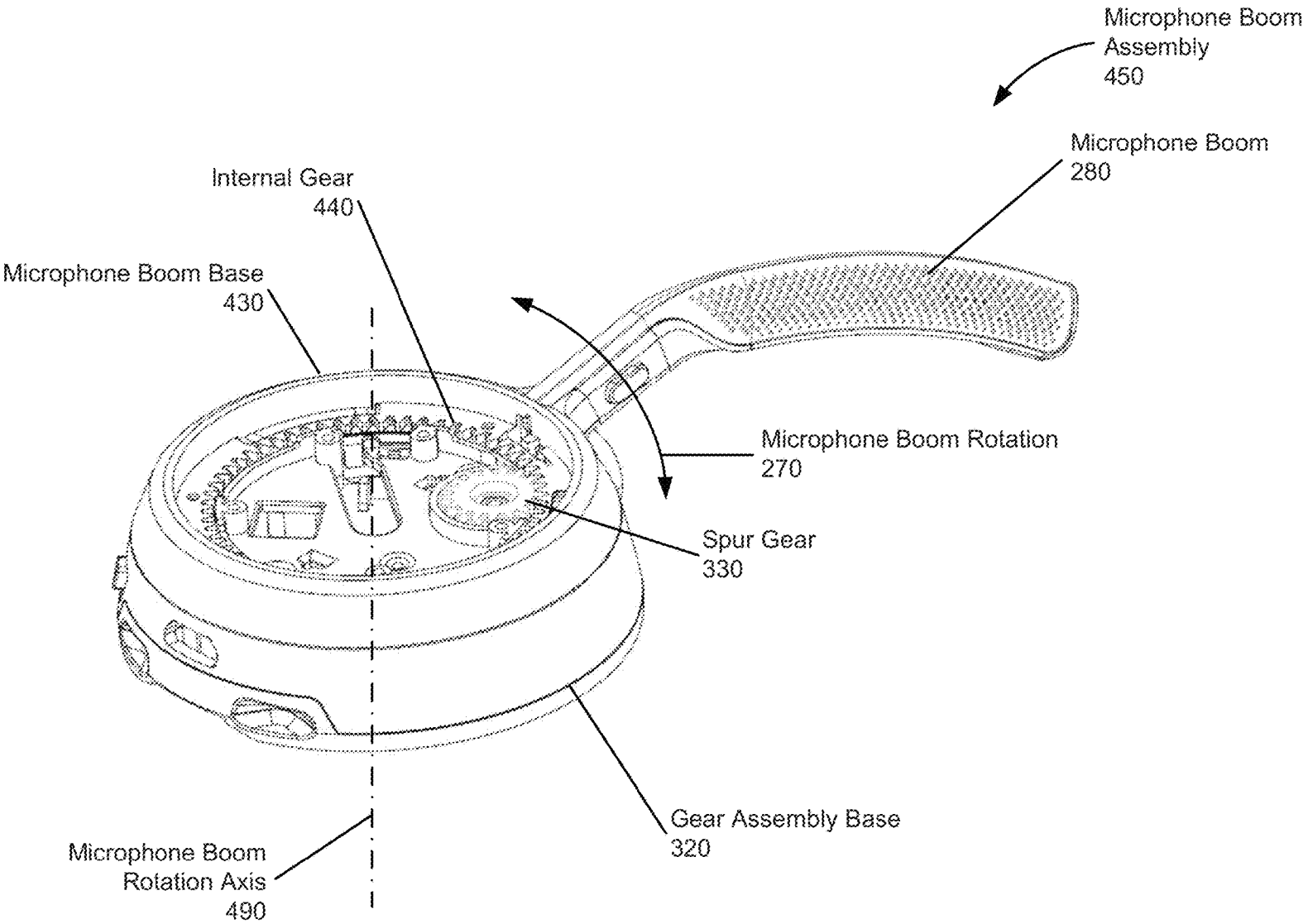

Turning to FIGS. 4A and 4B, microphone boom assemblies, in accordance with one or more embodiments of the disclosure, are shown. FIG. 4A shows a microphone boom assembly (400) with the microphone boom base (430)

separated from the gear assembly base (320), e.g., during assembly or disassembly of the microphone boom assembly (400). FIG. 4B shows a microphone boom assembly (450) with the microphone boom base (430) disposed on the gear assembly base (320).

The gear assembly base (320) of the gear assembly (220) may be as previously described. In one or more embodiments, the gear assembly base is configured to receive a microphone boom base (430). The microphone boom base (430) may be substantially ring-shaped, and the microphone boom (280) may be disposed at the periphery of the ring-shaped microphone boom base (430). Ring-shaped is a shape having a circular outer circumference and a circular hole forming a circular inner circumference of the shape. The circular hole and the shape have a same center. When disposed on the gear assembly base (320), the microphone boom base (430) may rotate about a microphone boom rotation axis (490), thereby enabling the microphone boom rotation. The microphone boom base (430) may be held in place on the gear assembly base (320) (while still allowing the rotation about the microphone boom rotation axis (490)) using a gear cover, described in reference to FIGS. 5A and 5B. Any other type of mechanical attachment may be used, without departing from the disclosure.

In one or more embodiments, the microphone boom base (430) comprises an internal gear (440). The internal gear (440) is configured to engage with the spur gear (330). In particular, the internal gear (440) is a set of gear teeth on the circular inner circumference of the microphone boom base (430). Based on the respective locations of the microphone boom base and the spur gear, the set of gear teeth of the internal gear (440) are arranged to engage with a set of gear teeth on the outer circumference of the spur gear (330).

Accordingly, when a microphone boom rotation (270) occurs, e.g., by the user of the communication headset applying a force/torque to the microphone boom (280), the microphone boom rotation (270) causes a spur gear rotation (480). As previously described, the friction associated with the spur gear (330) and the spur gear rotation (480) counters the microphone boom rotation (270). Because of the gear ratio provided by the combination of the spur gear (330) and the internal gear (440), a relatively small friction associated with the spur gear (330) may result in sufficient friction to hold the microphone boom in a stationary position/orientation, unless the user applies a force/torque to cause the microphone boom rotation (270). While a single spur gear (330) is shown, additional spur gears may be added to increase the force/torque countering the microphone boom rotation (270).

Figure 5A:
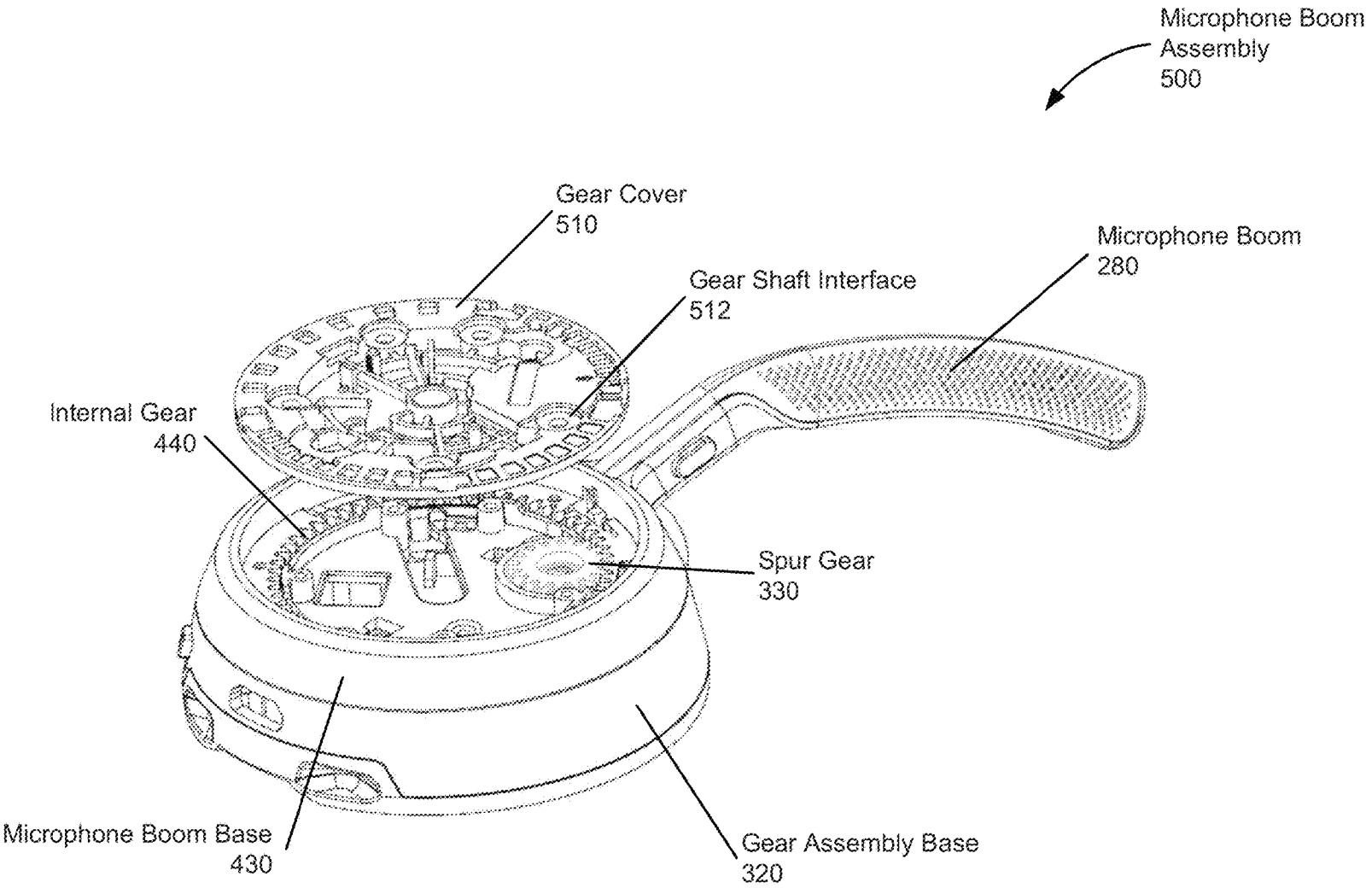
FIGS. 5A and 5B show microphone boom assemblies in accordance with one or more embodiments of the invention.
Figure 5B:
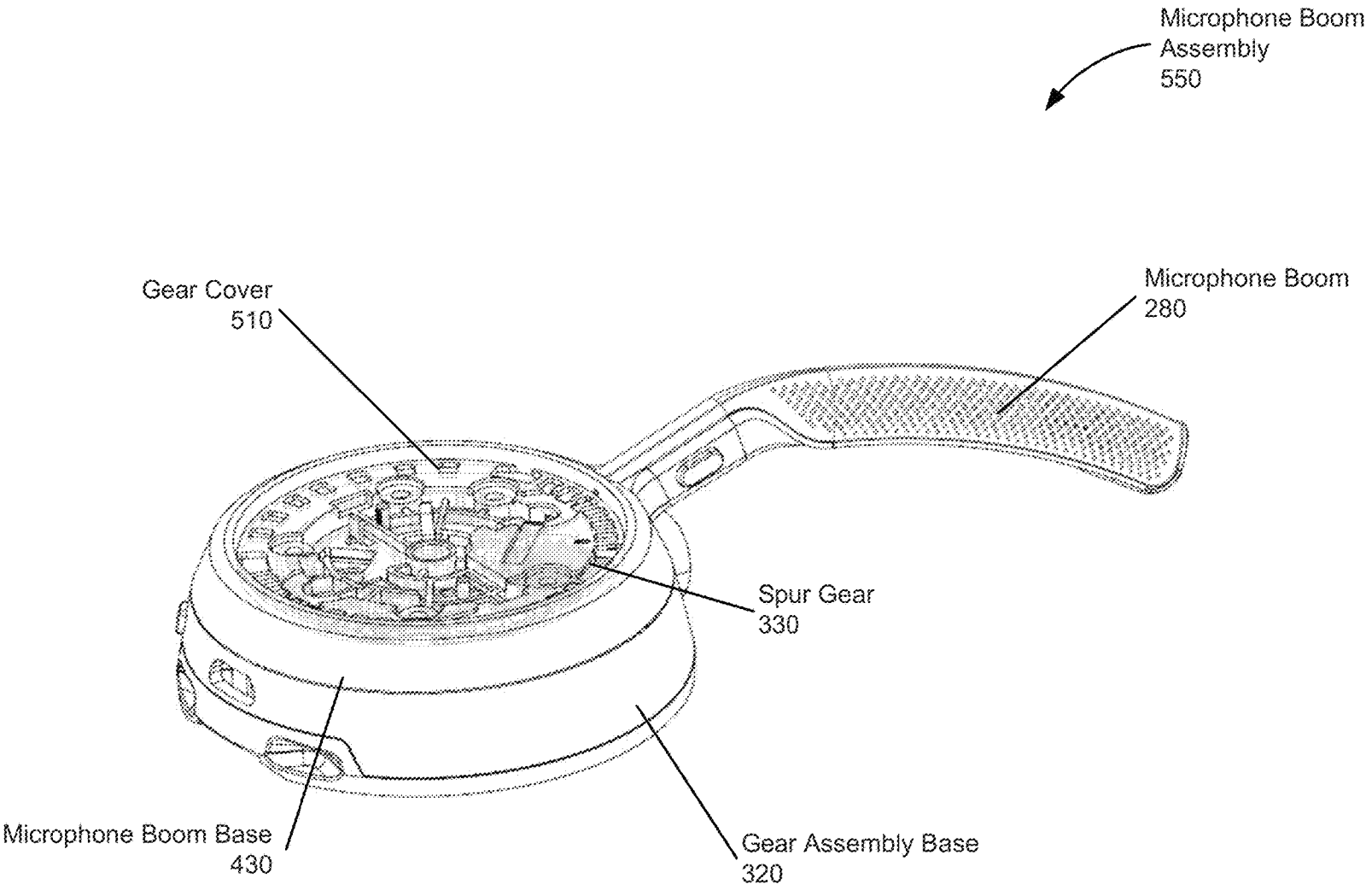

Turning to FIGS. 5A and 5B, microphone boom assemblies, in accordance with one or more embodiments of the disclosure, are shown. FIG. 5A shows a microphone boom assembly (500) with the gear cover (510) separated from the gear assembly base (320), e.g., during assembly or disassembly of the microphone boom assembly (500). FIG. 5B shows a microphone boom assembly (550) with the gear cover (510) disposed on the gear assembly base (320).

The microphone boom assemblies (500, 550) include a gear cover (510), in addition to the previously described components such as the microphone boom (280), the gear assembly base (320), the spur gear (330), the microphone boom base (430), and the internal gear (440).

The gear cover (510) may be clipped, screwed, glued or attached to the gear assembly base in any other manner. The gear cover (510) may include a gear shaft interface (512) similar to the gear shaft interface (322) to support the spur gear (330). The gear cover (510) may be configured to apply a pressure to the O-Ring (340) (or other component), to increase the friction that may be produced at the spur gear (330).

Depending on the combination of the components described in reference to FIGS. 1, 2, 3, 4A, 4B, 5A, and 5B, different characteristics of the microphone boom rotation (270) may be accomplished. Specifically, the force/torque experienced by the user when performing the microphone boom rotation may vary depending on, for example, the gear ratio (spur gear (330), internal gear (440)), the material and/or surface of the O-ring (340), the spur gear (330), and the gear assembly base (320), the number of spur gears (330), and/or the pressure applied to the O-ring (340).

Figure 6:
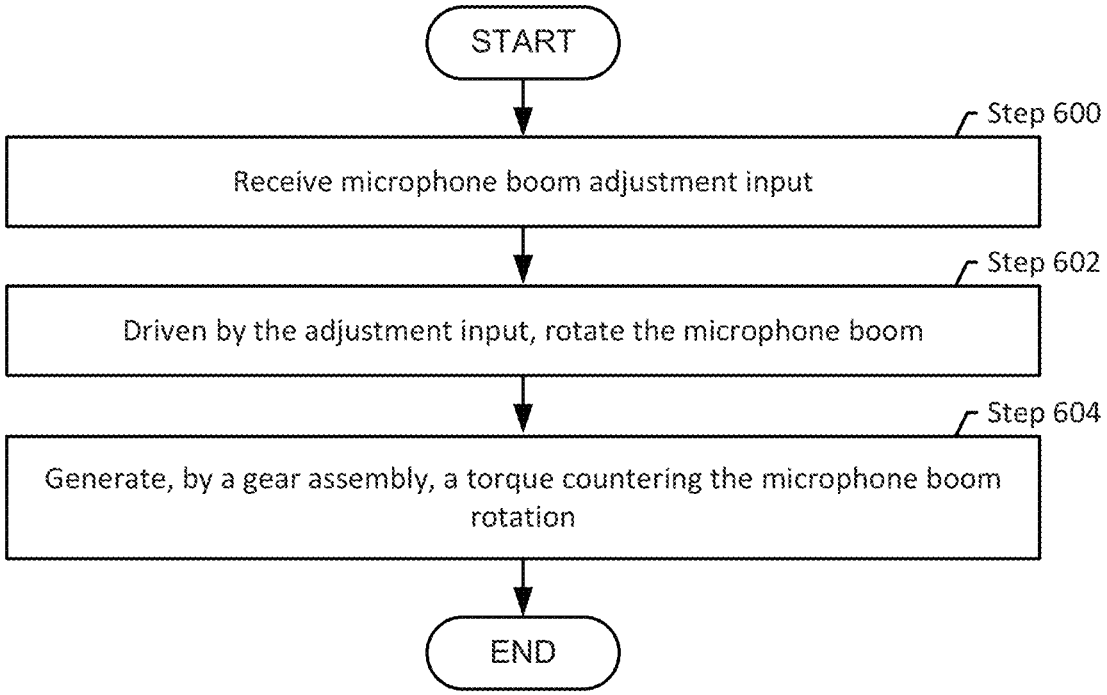
FIG. 6 shows a flowchart describing a method for adjusting a microphone boom of a headset in accordance with one or more embodiments of the disclosure.

FIG. 6 shows a flowchart in accordance with one or more embodiments of the invention. While the various steps in these flowcharts are provided and described sequentially, one of ordinary skill will appreciate that some or all of the steps may be executed in different orders, may be combined or omitted, and some or all of the steps may be executed in parallel.

Turning to FIG. 6, in Step 600, a user of the communication headset is performing an adjustment of the microphone boom. The user may apply a force/torque to the microphone boom, to cause a pivoting of the microphone boom about the microphone boom rotation axis, as shown in FIG. 1. In other words, the communication headset receives a microphone boom adjustment input.

In Step 602, the microphone boom rotates, driven by the adjustment input.

In Step 604, a torque countering the microphone boom rotation is generated by the gear assembly of the communication headset. The torque may be generated by various elements as described in reference to FIGS. 1, 2, 3, 4A, 4B, 5A, and 5B.

Those skilled in the art will appreciate that the steps described in FIG. 6 may be performed in different orders and/or the steps may be performed in parallel. Specifically, for example, the generation of the torque in Step 604 may occur concurrently with the rotating of the microphone boom in Step 602.

Various embodiments of the disclosure have one or more of the following advantages. Embodiments of the disclosure enable a microphone boom rotation mechanism. When the microphone boom is rotated, the microphone boom rotation mechanism produces a torque countering the rotation. Accordingly, a user may adjust the microphone boom, while the microphone boom may remain stationary when not operated by the user. In comparison to conventional microphone boom rotation mechanisms which may be ratchet-based or spring arm-based and may produce a significant amount of noise when operated, the microphone boom rotation mechanism, in accordance with one or more embodiments, operates quietly. Unlike in conventional microphone boom rotation mechanism, the microphone on the microphone boom may not pick up noise generated by the microphone boom rotation mechanism.

In comparison to other solutions that use friction between components (e.g., an O-ring) without a gear, the microphone boom ration mechanism, in accordance with one or more embodiments, produces a torque that is consistent and that depends less on tight manufacturing tolerances.

Embodiments of the disclosure are suitable for applications different from microphone booms. Any adjustable element or system, where a defined torque countering a movement is desirable, may benefit.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A communication headset comprising:

an earcup;

a headband; and a microphone boom assembly comprising:

a microphone boom, and a gear assembly disposed on the earcup and supporting the microphone;

a first spur gear engaging with a gear associated with the microphone boom; and a gear assembly base rotatably supporting the microphone boom, and rotatably supporting the first spur gear, wherein:

the rotation of the microphone boom causes rotation of the first spur gear, and the gear assembly enables a rotation of the microphone boom.

2. The communication headset of claim 1, wherein a friction associated with the first spur gear counters the rotation of the microphone boom.

3. The communication headset of claim 2, wherein the friction is between the first spur gear and the gear assembly base.

4. The communication headset of claim 2, wherein the gear assembly further comprises an O-ring disposed between the first spur gear and the gear assembly base, and wherein the friction is between the first spur gear and the O-ring.

5. The communication headset of claim 2, wherein the gear assembly further comprises a washer disposed between the first spur gear and the gear assembly base, and wherein the friction is between the first spur gear and the washer.

6. The communication headset of claim 1, wherein the microphone boom comprises a ring-shaped microphone boom base disposed on the gear assembly base, and wherein the gear associated with the microphone boom is an internal gear of the microphone boom base.

7. The communication headset of claim 1, wherein the gear assembly further comprises:

a second spur gear engaging with the gear associated with the microphone boom, wherein the rotation of the microphone boom causes rotation of the second spur gear.

8. The communication headset of claim 1, wherein the gear assembly base is a component of the earcup.

9. A gear assembly for rotation of a microphone boom of a communication headset, the gear assembly comprising:

a first spur gear engaging with a gear associated with the microphone boom, wherein the rotation of the microphone boom causes rotation of the first spur gear; and a gear assembly base rotatably supporting the microphone boom, and rotatably supporting the first spur gear.

10. The gear assembly of claim 9, wherein a friction associated with the first spur gear counters the rotation of the microphone boom.

11. The gear assembly of claim 10, wherein the friction is between the first spur gear and the gear assembly base.

12. The gear assembly of claim 10, further comprising an O-ring disposed between the first spur gear and the gear assembly base, and wherein the friction is between the first spur gear and the O-ring.

13. The gear assembly of claim 10, further comprising a washer disposed between the first spur gear and the gear assembly base, and wherein the friction is between the first spur gear and the washer.

14. The gear assembly of claim 9, wherein the microphone boom comprises a ring-shaped microphone boom base disposed on the gear assembly base, and wherein the gear associated with the microphone boom is an internal gear of the microphone boom base.

15. The gear assembly of claim 9, further comprising a second spur gear engaging with the gear associated with the microphone boom, wherein the rotation of the microphone boom causes rotation of the second spur gear.

16. The gear assembly of claim 9, wherein the gear assembly base is a component of an earcup of the communication headset.

17. A method for controlling rotation of a microphone boom of a communication headset, the method comprising:

receiving a microphone boom adjustment input;

driven by the adjustment input, rotating the microphone boom;

generating, by a gear assembly of the communication headset, a torque countering the rotation of the microphone boom, wherein the gear assembly comprises:

a spur gear engaging with a gear associated with the microphone boom, and a gear assembly base rotatably supporting the microphone boom, and rotatably supporting the spur gear, wherein the rotation of the microphone boom causes rotation of the spur gear.

18. The method of claim 17, wherein generating the torque comprises generating a friction between the spur gear and the gear assembly base.

* * * * *